US006547073B1

(12) United States Patent
Lee

(10) Patent No.: US 6,547,073 B1
(45) Date of Patent: Apr. 15, 2003

(54) SOCKET SUSPENDER

(76) Inventor: Daniel Lee, No. 62, Jen-Mei Rd., 3 Lin, Jen-Hua Li, Tali City Taichung Hsien (TW)

( * ) Notice: Subject to any disclaimer, the term of this patent is extended or adjusted under 35 U.S.C. 154(b) by 19 days.

(21) Appl. No.: 09/960,779

(22) Filed: Sep. 24, 2001

(51) Int. Cl.[7] ..... B65D 75/56
(52) U.S. Cl. ..... 206/378; 206/461; 206/477
(58) Field of Search ..... 206/461, 467, 206/471, 349, 372, 373, 378, 477, 495, 1.5

(56) References Cited

U.S. PATENT DOCUMENTS 5,906,350 A * 5/1999 Kao ..... 248/688
6,076,669 A * 6/2000 Ling ..... 206/349

FOREIGN PATENT DOCUMENTS

GB 2243592 * 11/1991

* cited by examiner

*Primary Examiner*—Jacob K. Ackun
(74) *Attorney, Agent, or Firm*—Charles E. Baxley

(57) ABSTRACT

A socket suspender includes a support plate, a positioning rack detachably mounted on the support plate, and a positioning bolt for securing the positioning rack on the support plate. In such a manner, the positioning rack may be secured on and detached from the support plate easily and quickly by screwing or unscrewing the positioning bolt, so that the socket may be stored in the socket suspender when not in use or taken out from the socket suspender when in use easily and quickly, thereby facilitating the user using or storing the socket.

4 Claims, 5 Drawing Sheets

SOCKET SUSPENDER

BACKGROUND OF THE INVENTION

1. Field of the Invention

The present invention relates to a socket suspender, and more particularly to a socket suspender that may be used to support and suspend sockets of different sizes.

2. Description of the Related Art

A conventional socket suspender in accordance with the prior art comprises a base plate, and a fixing rack secured on the base plate for securing and store a socket between the base plate and the fixing rack. However, when in use, the user has to break the fixing rack to take out the socket from the base plate for use. Thus, the entire structure the conventional socket suspender is broken, so that the socket has to be stored in an additional tool box, and cannot be stored in the conventional socket suspender when not in use, thereby causing inconvenience to the user, and causing consumption of material.

SUMMARY OF THE INVENTION

The present invention has arisen to mitigate and/or obviate the disadvantage of the conventional socket suspender.

The primary objective of the present invention is to provide a socket suspender that may be used to support and suspend sockets of different sizes.

Another objective of the present invention is to provide a socket suspender, wherein the socket may be stored in the socket suspender when not in use or taken out from the socket suspender when in use easily and quickly, thereby facilitating the user using or storing the socket.

A further objective of the present invention is to provide a socket suspender that may be used continuously without having to break or throw away the whole socket suspender when the socket is taken out from the socket suspender, thereby enhancing the versatility and usage of the socket suspender, and thereby preventing consumption of material.

In accordance with the present invention, there is provided a socket suspender comprising: a support plate, a positioning rack detachably mounted on the support plate, and a positioning bolt for securing the positioning rack on the support plate, wherein,

- the support plate is provided with four support studs, and a central support stud located in a central portion between the four support studs, a support post is formed on and extended outward from one end of the central support stud, a screw hole is formed in the support post;
- the positioning rack is provided with four positioning columns, and a central positioning column located in a central portion between the four positioning columns, each of the four positioning columns is rested on a respective one of the four support studs, the central positioning column is rested on the central support stud and is formed with a receiving hole for receiving the support post therein, a countersunk hole is formed on one end of the central positioning column, and is connected to the receiving holes; and
- the positioning bolt is extended through the countersunk hole of the central positioning column, and is screwed into the screw hole of the support post, thereby positioning the positioning rack on the support plate.

In such a manner, the positioning rack may be secured on and detached from the support plate easily and quickly by screwing or unscrewing the positioning bolt, so that the socket may be stored in the socket suspender when not in use or taken out from the socket suspender when in use easily and quickly, thereby facilitating the user using or storing the socket.

Further benefits and advantages of the present invention will become apparent after a careful reading of the detailed description with appropriate reference to the accompanying drawings.

DETAILED DESCRIPTION OF THE INVENTION

Figure 1:
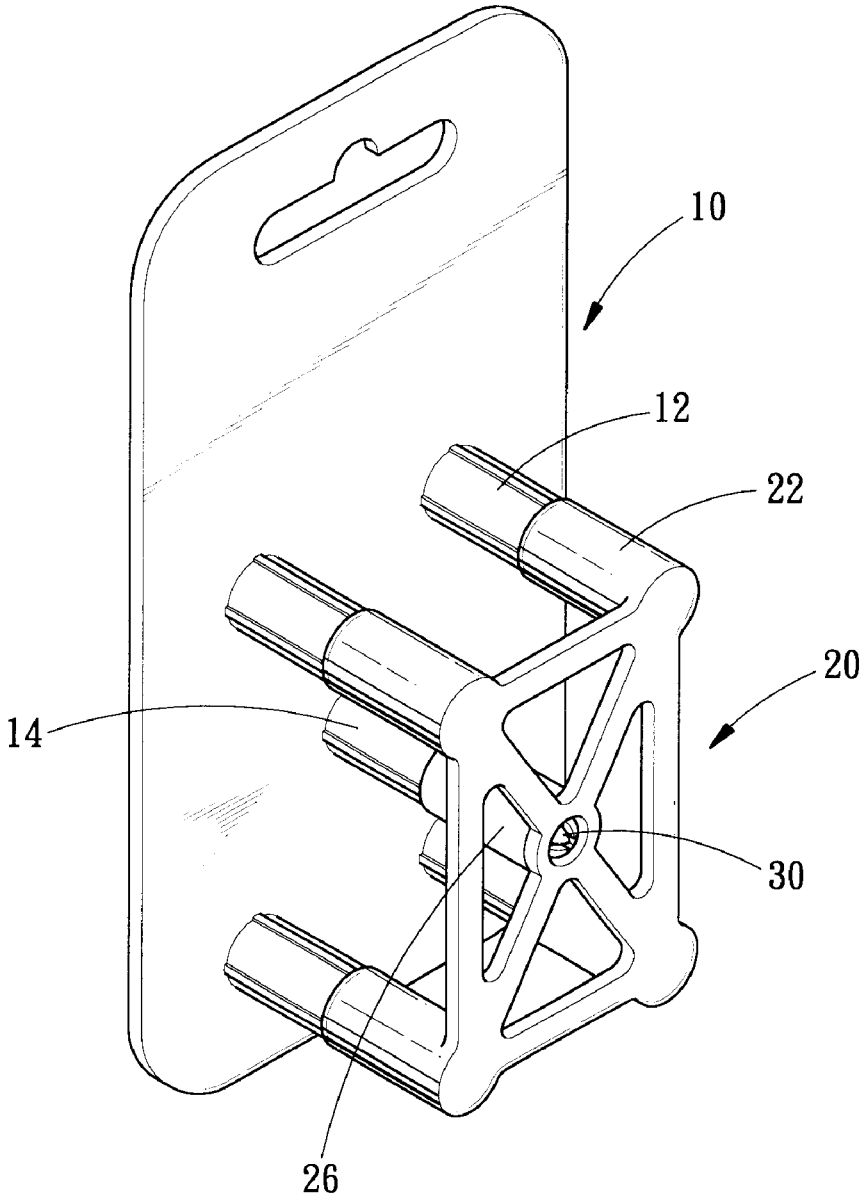
FIG. 1 is a perspective view of a socket suspender in accordance with a preferred embodiment of the present invention.
Figure 2:
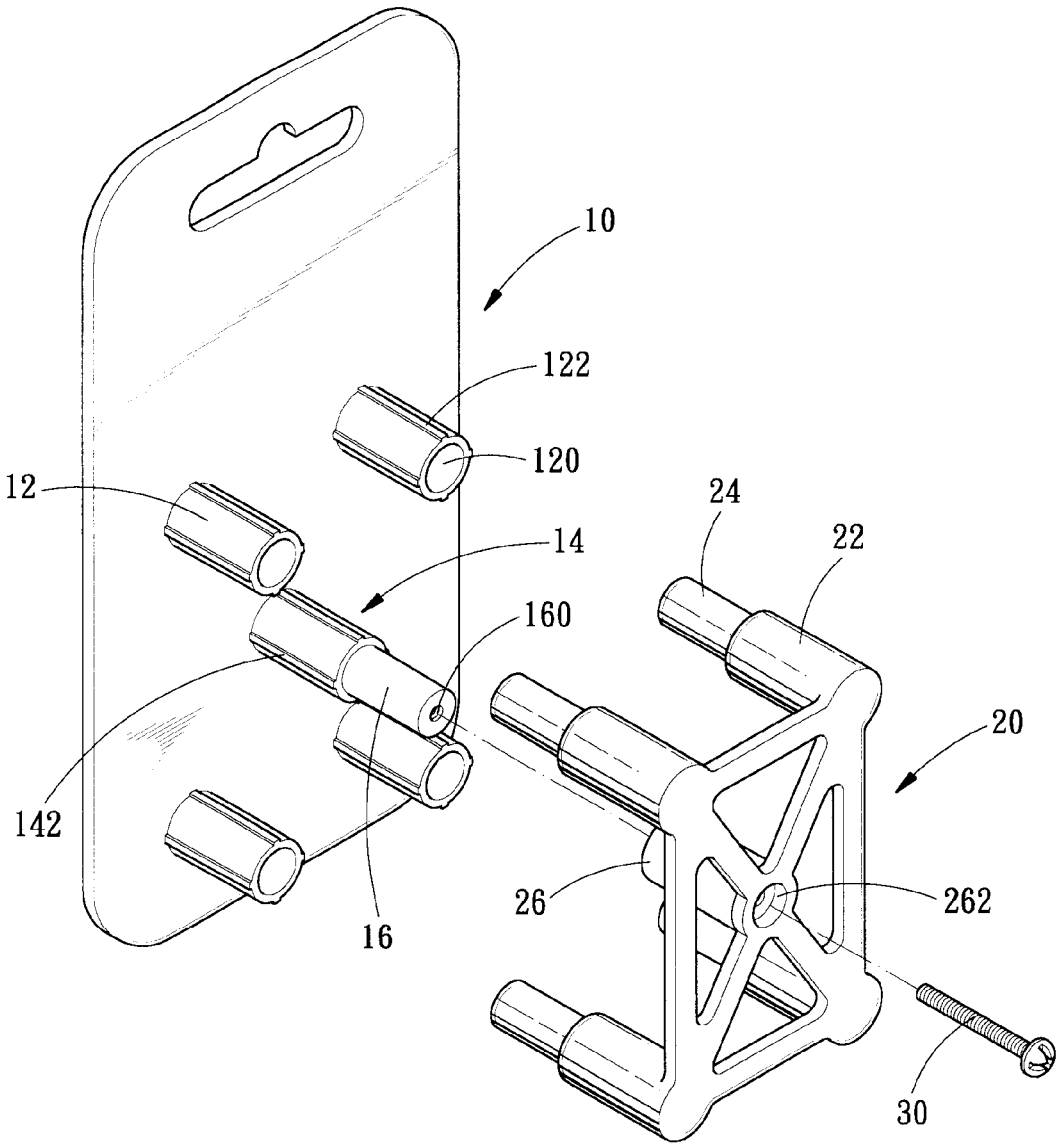
FIG. 2 is an exploded perspective view of the socket suspender as shown in FIG. 1.
Figure 3:
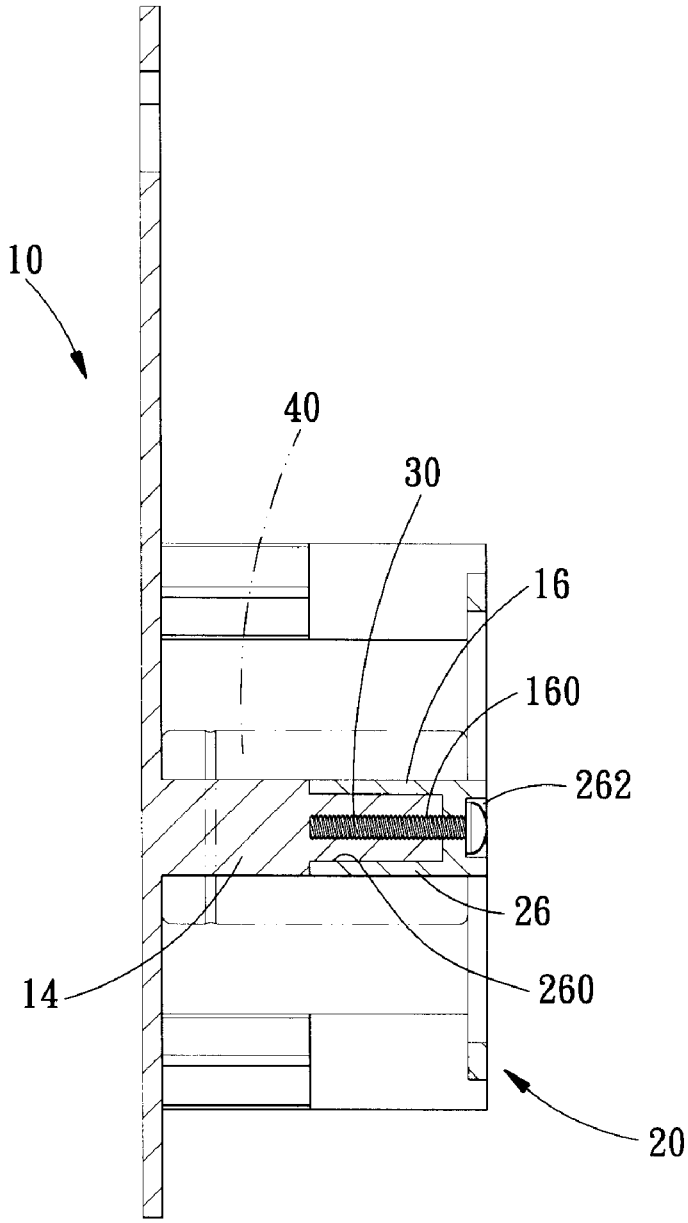
FIG. 3 is a side plan cross-sectional view of the socket suspender as shown in FIG. 1.

Referring to the drawings and initially to FIGS. 1–3, a socket suspender in accordance with the preferred embodiment of the present invention comprises a support plate 10, and a positioning rack 20 detachably mounted on the support plate 10.

The support plate 10 is provided with four support studs 12, and a central support stud 14 located in a central portion between the four support studs 12. Each of the four support studs 12 has an inner wall formed with an insertion hole 120, and an outer wall formed with a plurality of reinforcing ribs 122. The central support stud 14 has an outer wall also formed with a plurality of reinforcing ribs 142. A support post 16 is formed on and extended outward from one end of the central support stud 14, and a screw hole 160 is formed in the support post 16.

The positioning rack 20 is provided with four positioning columns 22, and a central positioning column 26 located in a central portion between the four positioning columns 22. Each of the four positioning columns 22 is rested on a respective one of the four support studs 12 and is provided with an insertion column 24 inserted into the insertion hole 120 of the respective support stud 12. The central positioning column 26 is rested on the central support stud 14, and is formed with a receiving hole 260 (see FIG. 3) for receiving the support post 16 therein. A countersunk hole 262 is formed on one end of the central positioning column 26, and is connected to the receiving holes 260.

A positioning bolt 30 is extended through the countersunk hole 262 of the central positioning column 26, and is screwed into the screw hole 160 of the support post 16, thereby positioning the positioning rack 20 on the support plate 10 as shown in FIG. 1.

In assembly, a socket 40 may be suspended on the central support stud 14. The positioning rack 20 is then mounted on the support plate 10, with the insertion columns 24 of the positioning columns 22 being inserted into the insertion holes 120 of the support studs 12, and with the support post 16 of the central support stud 14 being inserted into the receiving hole 260 of the central positioning column 26. The positioning bolt 30 may then be extended through the countersunk hole 262 of the central positioning column 26, and screwed into the screw hole 160 of the support post 16, thereby securing the positioning rack 20 on the support plate 10, so that the socket 40 may be suspended on the central support stud 14 and the central positioning column 26, and positioned between the positioning rack 20 and the support plate 10 as shown in FIGS. 3 and 4.

Figure 4:
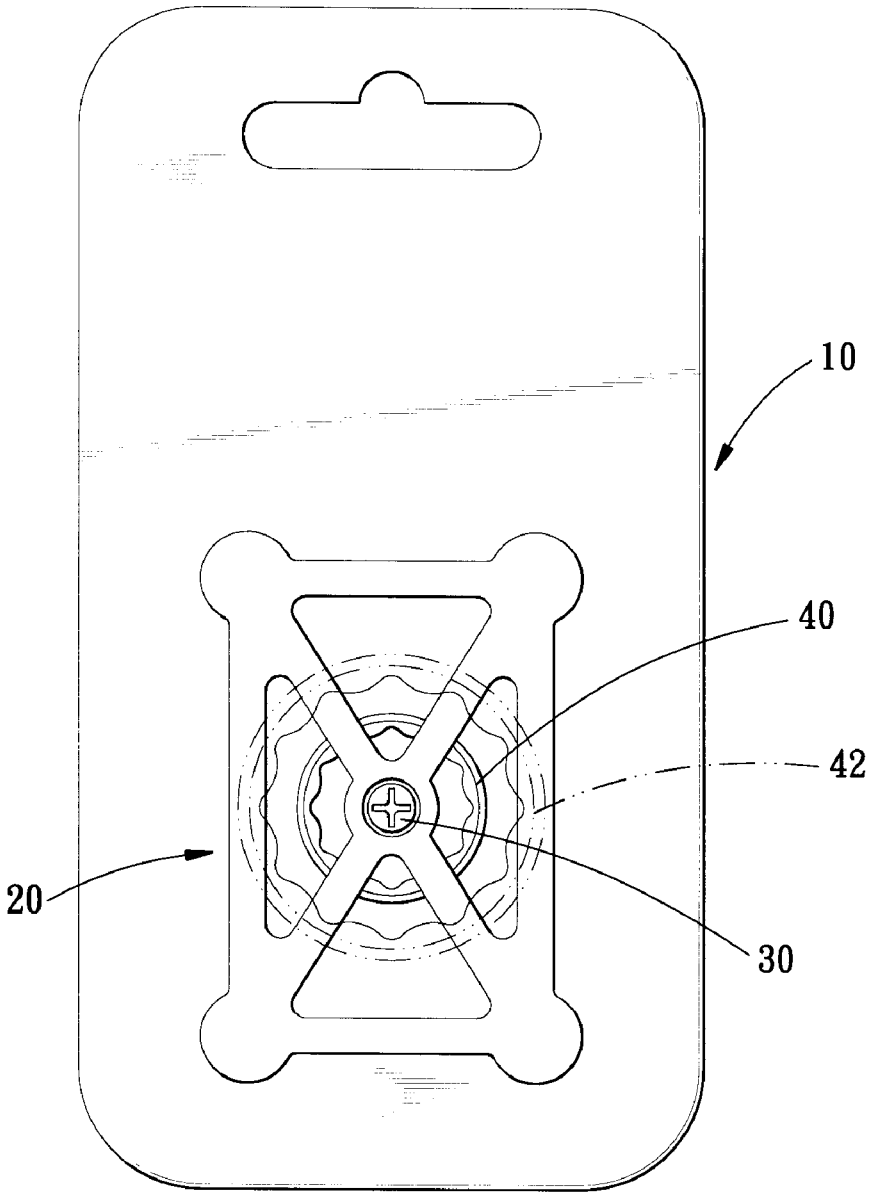
FIG. 4 is a schematic front plan view of the socket suspender as shown in FIG. 1.
Figure 5:
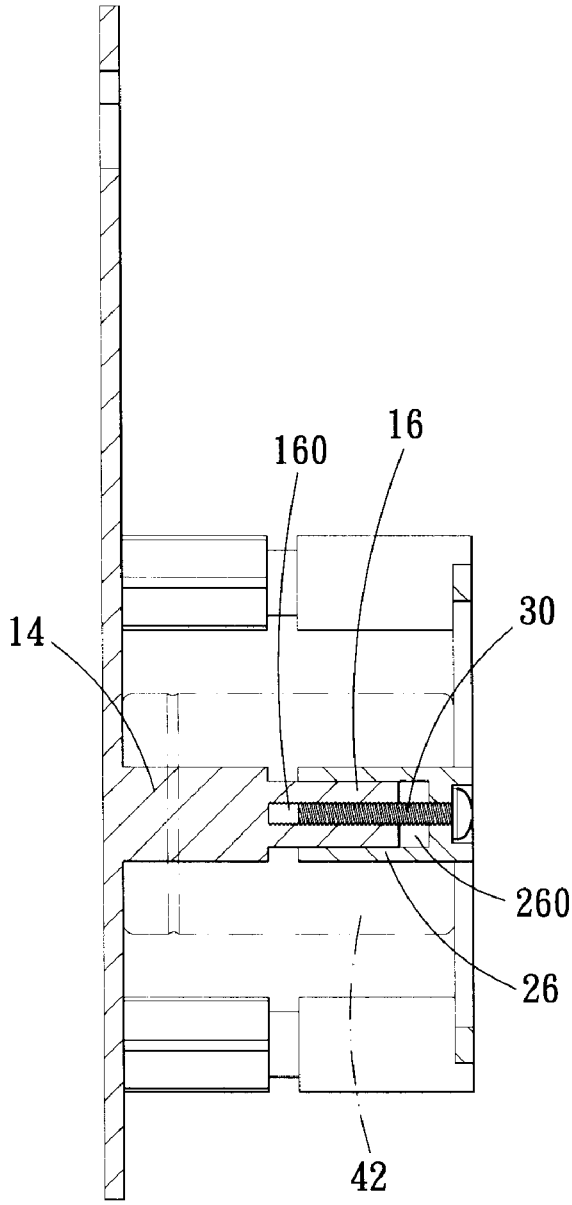
FIG. 5 is a schematic operational view of the socket suspender as shown in FIG. 3.

The positioning bolt 30 may be slightly unscrewed from the screw hole 160 of the support post 16, so that the positioning rack 20 may be slightly moved outward relative to the support plate 10, thereby increasing the distance between the central support stud 14 and the central positioning column 26, so that a socket 42 having a greater size may be suspended on the central support stud 14 and the central positioning column 26, and positioned between the positioning rack 20 and the support plate 10 as shown in FIGS. 4 and 5.

Thus, the socket suspender in accordance with the present invention may be used to support and suspend sockets of different sizes.

The positioning bolt 30 may be unscrewed from the screw hole 160 of the support post 16, thereby detaching the positioning rack 20 from the support plate 10, so that the socket 40 (or 42) may be taken out from the central support stud 14 for use.

Alternatively, the positioning bolt 30 may be screwed into the screw hole 160 of the support post 16, thereby securing the positioning rack 20 on the support plate 10, so that the socket 40 (or 42) may be supported and suspended on the central support stud 14 and the central positioning column 26, and positioned between the positioning rack 20 and the support plate 10 when not in use.

Thus, the positioning rack 20 may be secured on and detached from the support plate 10 easily and quickly by means of screwing or unscrewing the positioning bolt 30, so that the socket 40 (or 42) may be stored when not in use or taken out when in use easily and quickly, thereby facilitating the user using or storing the socket 40 (or 42).

In addition, the positioning rack 20 may be secured on and detached from the support plate 10 continuously without having to break the entire structure of the socket suspender for taking out the socket 40 (or 42), so that the socket suspender may be used continuously without having to throw away the whole socket suspender when the socket 40 (or 42) is taken out, thereby enhancing the versatility and usage of the socket suspender, and thereby preventing consumption of material.

While the preferred embodiment of the present invention has been shown and described, it will be apparent to those skilled in the art that various modifications may be made in the embodiment without departing from the spirit of the present invention. Such modifications are all within the scope of the present invention.

What is claimed is:

1. A socket suspender, comprising: a support plate, a positioning rack detachably mounted on the support plate, and a positioning bolt for securing the positioning rack on the support plate, wherein, the support plate is provided with four support studs, and a central support stud located in a central portion between the four support studs, a support post is formed on and extended outward from one end of the central support stud, a screw hole is formed in the support post;

the positioning rack is provided with four positioning columns, and a central positioning column located in a central portion between the four positioning columns, each of the four positioning columns is rested on a respective one of the four support studs, the central positioning column is rested on the central support stud and is formed with a receiving hole for receiving the support post therein, a countersunk hole is formed on one end of the central positioning column, and is connected to the receiving holes; and the positioning bolt is extended through the countersunk hole of the central positioning column, and is screwed into the screw hole of the support post, thereby positioning the positioning rack on the support plate.

2. The socket suspender in accordance with claim 1, wherein each of the four support studs has an inner wall formed with an insertion hole, and each of the four positioning columns is provided with an insertion column inserted into the insertion hole of the respective support stud.

3. The socket suspender in accordance with claim 1, wherein each of the four support studs has an outer wall formed with a plurality of reinforcing ribs.

4. The socket suspender in accordance with claim 1, wherein the central support stud has an outer wall formed with a plurality of reinforcing ribs.

* * * * *